US012442200B2

(12) United States Patent
Neuhofer

(10) Patent No.: US 12,442,200 B2
(45) Date of Patent: Oct. 14, 2025

(54) DEVICE FOR FASTENING A FINISHING STRIP

(71) Applicant: Franz Neuhofer, Zell am Moos (AT)

(72) Inventor: Franz Neuhofer, Zell am Moos (AT)

( * ) Notice: Subject to any disclaimer, the term of this patent is extended or adjusted under 35 U.S.C. 154(b) by 236 days.

(21) Appl. No.: 18/030,716

(22) PCT Filed: Jun. 28, 2021

(86) PCT No.: PCT/AT2021/060226
§ 371 (c)(1),
(2) Date: Apr. 6, 2023

(87) PCT Pub. No.: WO2022/073045
PCT Pub. Date: Apr. 14, 2022

(65) Prior Publication Data

US 2023/0374797 A1 Nov. 23, 2023

(30) Foreign Application Priority Data

Oct. 6, 2020 (AT) ..... A 50854/2020

(51) Int. Cl.
*E04F 19/04* (2006.01)

(52) U.S. Cl.
CPC ..... *E04F 19/0468* (2013.01)

(58) Field of Classification Search
CPC ..... E04F 19/0468
See application file for complete search history.

(56) References Cited

U.S. PATENT DOCUMENTS 8,171,698 B2 * 5/2012 Neuhofer ..... E04F 19/0468 52/287.1
2010/0071288 A1 * 3/2010 Jun ..... E04F 19/0468 52/288.1
2017/0130467 A1 * 5/2017 Neuhofer, Jr. ..... E04F 19/0468
(Continued)

FOREIGN PATENT DOCUMENTS

AT 519677 A4 * 9/2018 ..... E04F 19/0468
CH 694891 A5 8/2005
(Continued)

OTHER PUBLICATIONS

English Translation of AT 519677 (Year: 2018).*
(Continued)

*Primary Examiner* — Andrew J Triggs
(74) *Attorney, Agent, or Firm* — Tiajoloff & Kelly LLP

(57) ABSTRACT

A device for fastening an end strip (9) has a mounting bracket (1) forming a wall leg (3). The mounting bracket comprises a receiving web (8) that protrudes upwardly and is arranged offset transversely to the wall leg (3), and engages into a downwardly open receiving groove (10) of the end strip (9) to clampingly accommodate the end strip (9), and further comprises an elastic securing tongue (11) that is bent out of the receiving web (8) and latches into a latching recess (18) of the end strip (9). The securing tongue (11) forms a clamping web (14), which originates from the free longitudinal edge (13) of the receiving web (8) and is bent out towards the wall leg (3), and an adjoining latching web (15), which is bent back against the receiving web (8) and latches into the latching recess (18) of the end strip (9).

12 Claims, 3 Drawing Sheets

(56) References Cited

U.S. PATENT DOCUMENTS

Figure 2:
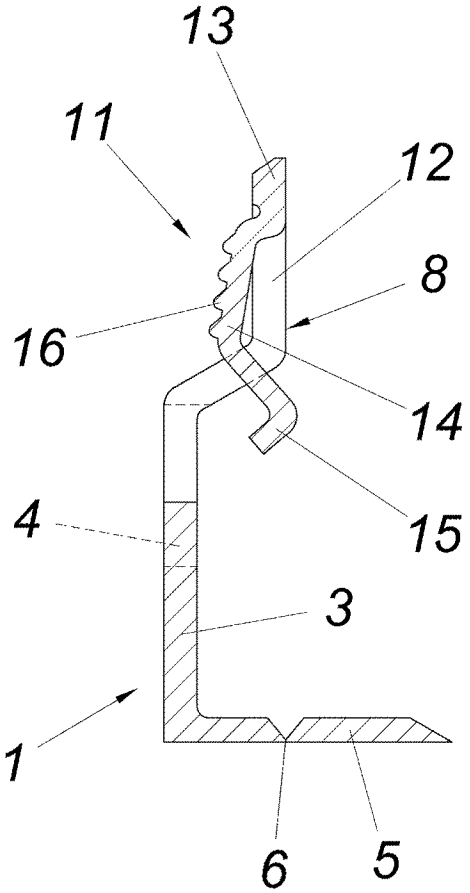

| | | | | |
|---|---|---|---|---|
| 2018/0195295 | A1* | 7/2018 | Neuhofer, Jr. ..... | E04F 19/0468 |
| 2019/0383036 | A1* | 12/2019 | Neuhofer ..... | E04F 19/0468 |

FOREIGN PATENT DOCUMENTS

| | | | | |
|---|---|---|---|---|
| CN | 107938997 | A | 11/2017 | |
| DE | 10360339 | A1 * | 8/2004 | ..... E04F 19/0468 |
| DE | 20 2005 011138 | U1 | 9/2005 | |
| DE | 102018119959 | A1 | 2/2020 | |
| EP | 2169143 | A2 | 3/2010 | |
| WO | 2006/049522 | A1 | 5/2006 | |
| WO | 2017/152199 | A1 | 9/2017 | |
| WO | 2019/000004 | A1 | 1/2019 | |

OTHER PUBLICATIONS

English Translation of DE10360339 (Year: 2004).*
Espacenet English language abstract for CH 694891 A5, Aug. 31, 2005.
Espacenet English language abstract for CN 107938997 A, Nov. 14, 2017.
Espacenet English language abstract for DE 20 2005 011138 U1, Sep. 29, 2005.

* cited by examiner

DEVICE FOR FASTENING A FINISHING STRIP

TECHNICAL AREA

The invention relates to a device for fastening an end strip with a mounting bracket forming a wall leg, said mounting bracket comprising a receiving web which protrudes upwardly and is arranged offset transversely to the wall leg as well as engages into a downwardly open receiving groove of the end strip for the clamping accommodation of the end strip, and further comprising an elastic securing tongue which is bent out of the receiving web and latches into a latching recess of the end strip.

STATE OF THE ART

In order to prevent, in the context of wall mounting brackets for fastening the end strips of a floor covering, the end strip from being unintentionally removed from a receiving web when the end strip is clamped onto the receiving web projecting upwards at a distance from the wall with a receiving groove open at the bottom, it is known (EP 2 169 143 A2) to provide an additional elastic securing tongue on the mounting bracket which engages in a latching recess of the end strip when the end strip is mounted on the receiving web of the mounting bracket. Since all that matters is that the securing tongue engages appropriately in the latching recess of the end strip, the securing tongue can be provided not only on the wall leg of the mounting bracket or on a support foot of the mounting bracket that can be placed on the floor covering, but also in the area of the receiving web, in order to be able to use the free space resulting between the wall leg, floor covering and end strip without hindrance. However, with the pull-off protection formed in the area of the clamping reception by an upwardly extending securing tongue, the advantage of additional support for the end strip, which can be achieved for example with a securing tongue in the floor area, can only be used imperfectly.

To improve the clamping of the end strip on the wall mounting bracket, it is also known (WO 2019/000004 A1) to divide the receiving web of the mounting bracket into three elastic tongues arranged side by side in the longitudinal direction of the web and projecting freely upwards, which are alternately concave or convex relative to the wall leg about axes parallel to the web. As a result of this design of the receiving web, the elastic tongues bulging out in opposite directions are pressed against each other under pretension when engaging in the receiving groove of the end strip with the effect transverse to the wall leg that they bear with their bulges against the opposing groove walls of the receiving groove of the end strip in a clamping manner. However, these elastic tongues, which are bulged out alternately in opposite directions, cannot replace securing tongues that prevent unintentional removal of the end strip from the mounting bracket.

REPRESENTATION OF THE INVENTION

The invention is thus based on the task of designing a device for fastening an end strip by simple constructional means in such a way that an elastic clamping fixture can be advantageously connected to a trigger safety device.

Starting from a device of the type described at the beginning, the invention solves the problem posed by the fact that the securing tongue forms a clamping web, which originates from the free longitudinal edge of the receiving web and is bent out towards the wall leg, and an adjoining latching web which is bent back against the receiving web and which latches into the latching recess of the end strip.

The clamping web of the elastic securing tongue, which clamping web extends from the free longitudinal edge of the receiving web and is bent out towards the wall leg, is bent back against the receiving web in an elastic, spring-like manner during the fitting of the end strip onto the mounting bracket and the resulting engagement in the receiving groove of the end strip, in such a way that the clamping web rests against the groove wall of the receiving groove of the end strip under an elastic prestress and is simultaneously used as an actuator for the latching web, which is pressed into the latching recess of the end strip in an elastic, spring-like manner by this loading of the clamping web. This means that due to the elastic pretensioning of the clamping web, the end strip is pressed against the wall and, in addition, due to the elastic pretensioning of the latching web, is subjected to a torque which supports the wall contact, with the latching web engaging in the latching recess to prevent withdrawal.

The securing tongues could be provided in extension of the receiving web of the mounting bracket. However, simpler design conditions result if the at least one securing tongue is provided in a passage opening of the receiving web.

To improve the clamping retention of the end strip on the receiving web, the clamping web of the securing tongue can be provided with clamping ribs on the side facing the wall leg, which clamping ribs interact with the adjacent groove wall of the receiving groove.

Since, due to the arrangement of the securing tongue on the receiving web, the locking of the end strip takes place with a corresponding distance to the floor, there may be a risk under certain circumstances that the end strip lifts off the wall in the area of its longitudinal edge on the wall side due to a force action in the floor area directed against the wall. To prevent this tilting movement, the mounting bracket can form at least one stop for the end strip arranged on the side of the latching web opposite the free longitudinal edge of the receiving web. This stop, which is provided vertically below the latching point of the end strip, prevents the end strip from tilting against its pretension as a result of the pivotability of the securing s. Simple design possibilities arise in this connection if the mounting bracket has two side flanks projecting from the wall leg, each forming a stop for the end strip.

BRIEF DESCRIPTION OF THE INVENTION

In the drawing, the object of the invention is shown, for example. It shows

Figure 1:
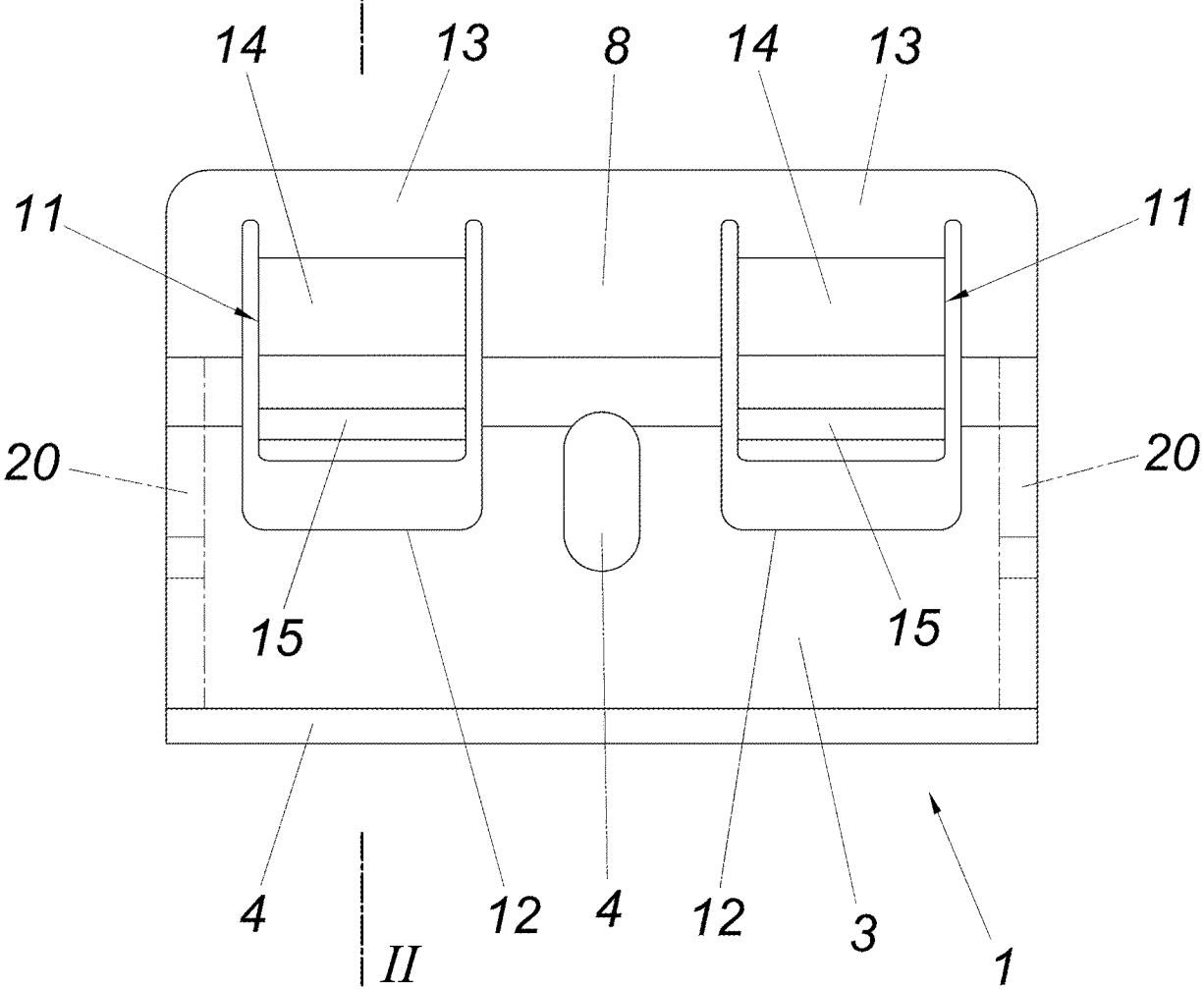
Figure 3:
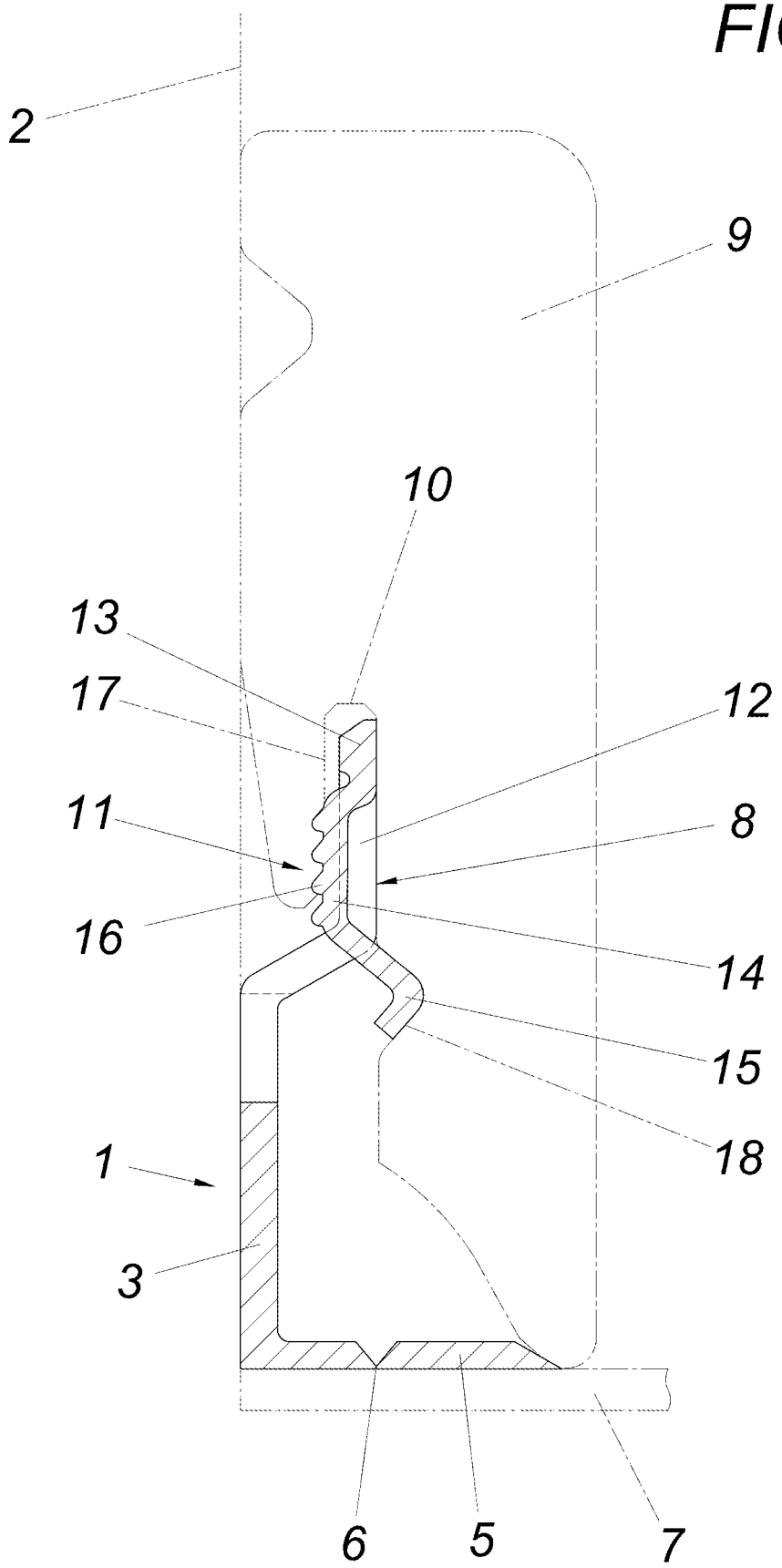
Figure 4:
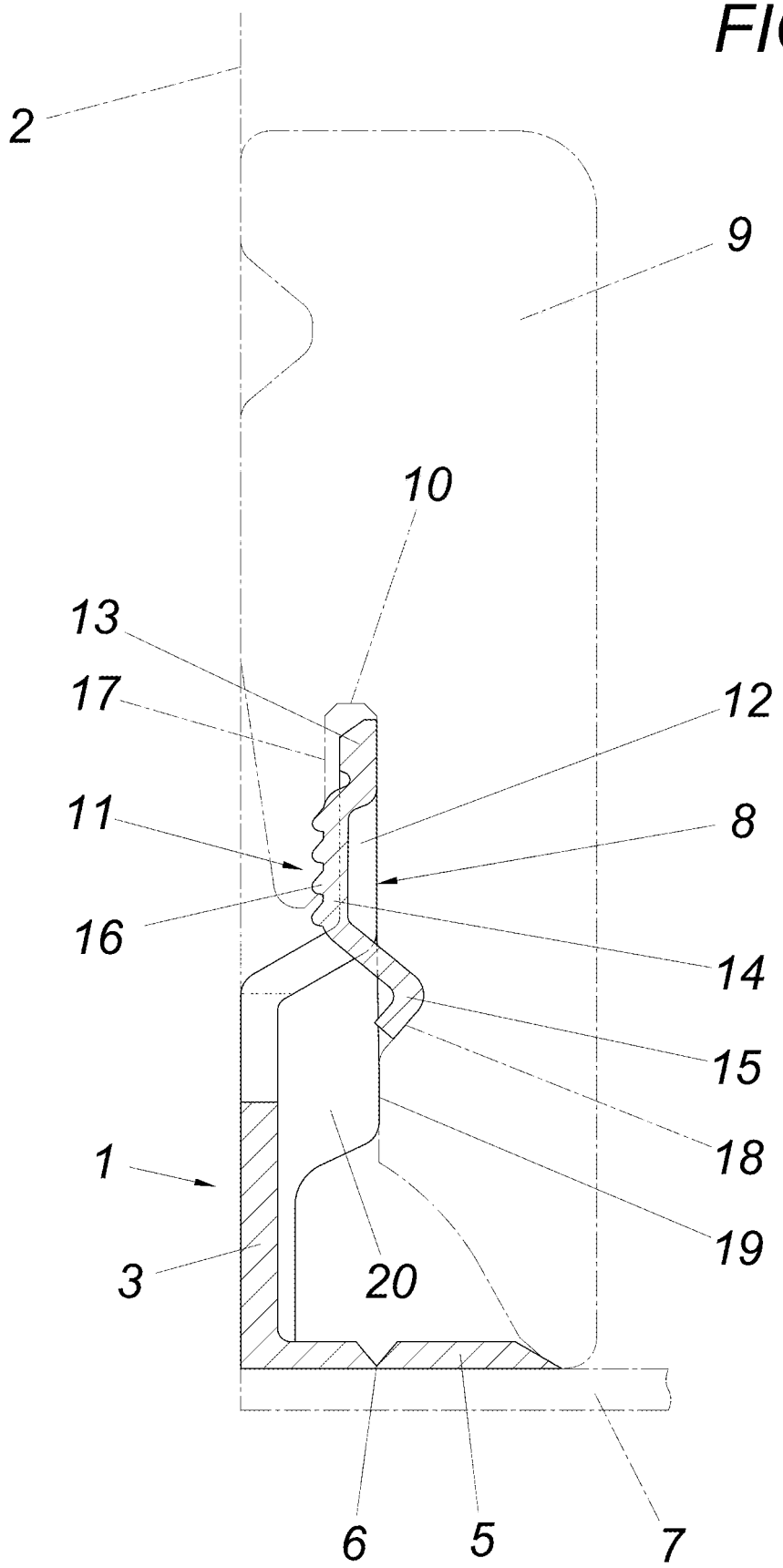

FIG. 1 a mounting bracket of a device according to the invention for fastening an end strip to a wall in a side view, FIG. 2 this mounting bracket in a section according to line II-II of FIG. 1, FIG. 3 a end strip fastened to a wall with the aid of a device according to the invention in a section through the mounting bracket on a larger scale corresponding to FIG. 2, and FIG. 4 a representation of an embodiment of the device according to the invention corresponding to FIG. 3.

WAYS TO CARRY OUT THE INVENTION

The device according to the invention has a mounting bracket 1, for example made of plastic, which forms a wall leg 3 that can be fastened to a wall 2 and is provided with at least one long hole 4 for a fastening screw. The wall leg 3 projects from a base leg 5, which is connected to the wall leg 3 via a predetermined breaking point 6 and can be separated from the wall leg 3 if necessary. With the aid of the floor leg 5, the mounting bracket 1 can be supported on a floor covering 7, whereby the height position of the mounting bracket relative to the floor covering 7 is easily fixed.

In the upper edge region, the wall leg 3 forms a receiving web 8 for the end strip 9 to be fastened to the wall 2, which for this purpose has a downwardly open receiving groove 10 for the receiving web 8. The receiving web 8, which is offset away from the wall 2 relative to the wall leg 3 and runs approximately parallel to the wall 2 or to the wall leg 3, is provided with two elastic securing tongues 11 arranged on both sides of the long hole 4, which are provided in a passage opening 12 of the receiving web 8 and form a clamping web 14 starting from the free longitudinal edge 13 of the receiving web 8 and a latching web 15 attached to the clamping web 14. While the clamping web 14, which is preferably provided with clamping ribs 16, is bent away from the longitudinal edge 13 of the receiving web 8 towards the wall leg 3, the latching web 15 attached to the clamping web 14 has a course that is bent back towards the receiving web 8.

If the end strip 9 is placed on the mounting bracket 1 fastened to a wall 2, the upwardly projecting receiving web 8 of the mounting bracket 1 engages in the downwardly open receiving groove 10 of the end strip 9, whereby according to FIG. 3 the clamping web 14 is bent back against the receiving web 8 by the groove wall 17 on the wall side in an elastic, spring-like manner. With this pivoting displacement of the clamping web 14, which forms an actuator for the latching web 15, the latching web 15 is also pivoted into its latching position, in which it latches into a latching recess 18 of the end strip 9 in an elastic, spring-like manner. The engagement of the clamping web 14 in the receiving groove 10 and of the latching web 15 in the latching recess 18 under an elastic pretension results in a simple and positionally secure fastening of the end strip 9. The end strip 9 is indeed pressed against the wall 2 by the clamping web 14 resting against the groove wall 17 and is additionally subjected to a tilting moment by the latching web 15, which additionally ensures that the end strip 9 rests against the wall. This does not adversely affect the pull-off protection of the end strip 9 by the latching web 15.

As can be seen directly from FIG. 3, the end strip 9 could be tilted away from the wall 2 by the action of a force in the floor area around the free longitudinal edge 13 of the receiving web 8 due to the pivotability of the securing tongue 11 in the area of the upper longitudinal edge if this is not prevented by a stop. In FIG. 4, the retainer 1 is provided with such a stop 19, which is arranged on the side of the latching web 15 opposite the free longitudinal edge 13 of the receiving web 8 and thus reliably prevents the end strip 9 from tilting about the free longitudinal edge 13 of the receiving web 8.

For this purpose, the mounting bracket 1 can advantageously be provided with two side flanks 20 projecting from the wall leg 3, each forming a stop 19, as shown in FIG. 4 and indicated by dashed dots in FIG. 1.

The invention claimed is:

1. A device for fastening an end strip, said device comprising:

a mounting bracket that has a wall leg and has an upwardly projecting receiving web having at least one elastic securing tongue;

wherein the receiving web is offset transversely with respect to the wall leg, and the end strip has a downwardly open receiving groove in which the receiving web clampingly engages; and wherein the securing tongue extends bent out of the receiving web and latches into a latching recess of the end strip;

wherein the securing tongue has a clamping web that extends downward starting from a free longitudinal upper edge of the receiving web and extends bent out therefrom towards the wall leg; and a latching web adjoining the clamping web;

wherein said latching web extends bent back towards the receiving web and latches into the latching recess of the end strip.

2. The device according to claim 1, wherein the receiving web has a passage opening, and the securing tongue is supported so as to extend in the passage opening of the receiving web.

3. The device according to claim 2, wherein the clamping web of the securing tongue has clamping ribs on a side thereof facing the wall leg.

4. The device according to claim 3, wherein the mounting bracket forms at least one stop for the end strip, wherein the at least one stop is arranged on a side of the latching web opposite the free longitudinal edge of the receiving web.

5. The device according to claim 4, wherein the mounting bracket has two side flanks projecting from the wall leg and each forming a stop for the end strip.

6. The device according to claim 2, wherein the mounting bracket forms at least one stop for the end strip, wherein the at least one stop is arranged on a side of the latching web opposite the free longitudinal edge of the receiving web.

7. The device according to claim 6, wherein the mounting bracket has two side flanks projecting from the wall leg and each forming a stop for the end strip.

8. The device according to claim 1, wherein the clamping web of the securing tongue has clamping ribs on a side thereof facing the wall leg.

9. The device according to claim 8, wherein the mounting bracket forms at least one stop for the end strip, wherein the at least one stop is arranged on a side of the latching web opposite the free longitudinal edge of the receiving web.

10. The device according to claim 9, wherein the mounting bracket has two side flanks projecting from the wall leg and each forming a stop for the end strip.

11. The device according to claim 1, wherein the mounting bracket forms at least one stop for the end strip, wherein the at least one stop is arranged on a side of the latching web opposite the free longitudinal edge of the receiving web.

12. The device according to claim 11, wherein the mounting bracket has two side flanks projecting from the wall leg and each forming a stop for the end strip.

* * * * *